US006745808B2

(12) United States Patent
Kobayashi

(10) Patent No.: US 6,745,808 B2
(45) Date of Patent: Jun. 8, 2004

(54) FILM TRANSFER APPARATUS

(75) Inventor: Kenji Kobayashi, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 2 days.

(21) Appl. No.: 10/223,460

(22) Filed: Aug. 20, 2002

(65) Prior Publication Data

US 2003/0037886 A1 Feb. 27, 2003

(30) Foreign Application Priority Data

Aug. 20, 2001 (JP) ..... 2001-249347

(51) Int. Cl.[7] ..... B32B 31/00

(52) U.S. Cl. ..... 156/577; 156/523; 156/579; 118/76; 206/411; 242/160.4; 242/171; 242/588.6

(58) Field of Search ..... 156/577, 579, 156/523, 574, 527, 238, 540; 242/588.2, 170, 171, 588.6, 160.2, 588, 588.3, 160.4; 225/46; 206/411; 118/76, 200, 257

(56) References Cited

U.S. PATENT DOCUMENTS 5,379,477 A 1/1995 Tamai et al.

6,599,363 B2 * 7/2003 Narita ..... 118/76

* cited by examiner

*Primary Examiner*—Richard Crispino
*Assistant Examiner*—Cheryl N. Hawkins
(74) *Attorney, Agent, or Firm*—Sughrue Mion, PLLC

(57) ABSTRACT

A film transfer apparatus capable of carrying out a transfer tape replacement operation easily. In an apparatus body formed by separably combining a main case member (4) and a covering case member (5) with each other to a body, a boss (14) of a feed gear (12) is fitted in a pressure contacting state around an inner cylinder of an intermediate connecting member (22) which has a double cylindrical portion of the inner cylinder and an outer cylinder, and the intermediate connecting member is engaged with and rotatably supported on a support shaft (28) having a locking portion (31), which is provided on an inner surface of the main case member with a feed reel fitted around the outer cylinder so that the feed reel can be engaged with the same. The covering case member (5) is provided on an inner surface thereof with a support shaft (25) on and with which the feed reel and a take-up reel are supported rotatably and engaged.

5 Claims, 5 Drawing Sheets

FILM TRANSFER APPARATUS

The following disclosure is based on Japanese Patent Application No. 2001-249347, filed on Aug. 20, 2001, which is incorporated into this application by reference.

FIELD OF AND BACKGROUND OF THE INVENTION

The invention relates to a film transfer apparatus adapted to transfer a correction film or a film of paste, which is attached to a transfer tape fed from a feed reel, onto a surface of a sheet by gripping the apparatus and moving the same rearward while pressing the same against the surface of the sheet.

Known film transfer apparatuses include a type which is capable of replacing a transfer tape with another, besides throw-away type film transfer apparatuses.

The former type of film transfer apparatuses include a type in which a cartridge formed of a flanged case member holding a transfer tape therein is replaced with another similar cartridge, and a non-cartridge type film transfer apparatus in which a transfer tape as well as a feed reel and some other parts are replaced with another transfer tape and a set of similar parts.

However, in any of these replaceable type film transfer apparatuses, a part not to be replaced, for example, a feed gear may fall from an apparatus body during a transfer tape replacement operation, so that the replacement of a transfer film takes much time in not a few cases.

Especially, in a non-cartridge type film transfer apparatus, a part not to be replaced is liable to fall off, and it was necessary that a careful attention is paid to a tape replacement operation.

In a film transfer apparatus of the type in which a cartridge formed of a flanged case member holding a transfer tape therein is replaced with another, the cost of forming the flanged cartridge-holding case member in addition to an apparatus body is high.

OBJECTS OF THE INVENTION

An object of the present invention is to provide a film transfer apparatus adapted to prevent parts not to be replaced from falling from an apparatus body during a transfer tape replacement operation. Another object of the present invention is to provide a film transfer apparatus adapted to carry out a transfer tape replacement operation more easily. Yet another object of the present invention is to provide a film transfer apparatus which can be manufactured at low costs having a pair of case members which form an apparatus body, and a cartridge.

SUMMARY OF THE INVENTION

These and other objects are solved in accordance with the present invention by a film transfer apparatus which has a lower end-opened apparatus body formed by combining in one body in a separable condition a pair of case members with the opened sides thereof opposed to each other, a feed reel and a take-up reel provided in the apparatus body, a transfer head projecting outward from the lower opening, and a transfer tape wound around the feed reel, and adapted to be fed, reversed at a tip of the transfer head and taken up around the take-up reel, said apparatus including a feed gear and a take-up gear provided coaxially with the feed reel and take-up reel respectively and meshing with each other, an intermediate connecting member carrying a cylindrical portion, a boss of the feed gear fitted around the cylindrical portion of the connecting member in such a pressure contacting state that it enables torque to be transmitted between the intermediate connecting member and feed gear, and the boss to have a sliding function with respect to a load of a level not lower than a required level, a support shaft carrying a locking portion and provided on an inner surface of one of the two case members which form an apparatus body on which support shaft the intermediate connecting member is supported by rotatably engaging the connecting member with the support shaft by utilizing the locking portion of the latter, and a diametrically enlarged portion, the diameter of which is larger than that of the boss, provided on an outer circumference of the cylindrical portion of the intermediate connecting member so that the feed reel can be engaged with the cylindrical portion by fitting the feed reel therearound by utilizing the diametrically enlarged portion.

According to an embodiment of the present invention, the intermediate connecting member can have a double cylindrical portion formed of an inner cylinder and an outer cylinder joined together at one end of each thereof and opened at the other end of each thereof, the boss of the feed gear being fitted in a pressure contacting state around the inner cylinder from the opening thereof, locking ribs being provided on an outer circumferential surface of the outer cylinder, the feed reel provided with locking ribs on an inner circumferential surface thereof being fitted around the outer cylinder with the locking ribs of these two parts engaged with one another.

According to still another embodiment of the present invention, the boss of the feed gear can be provided with a suitable number of slits, projections being provided on the portions of an inner circumferential surface of the boss which are among the slits, these projections being elastically engaged with the outer circumferential surface of the inner cylinder of the intermediate connecting member.

According to a further embodiment of the present invention, the case member which is other than the case member provided with the support shaft which supports the intermediate connecting member is provided on an inner surface thereof with a support shaft which supports the feed reel and take-up reel rotably and directly or indirectly, and which engages these reels with each other.

According to yet another embodiment of the present invention, the feed gear and take-up gear are transposed.

BRIEF DESCRIPTION OF THE DRAWINGS

The invention as well as embodiments and advantages thereof are described in greater detail with reference to the drawings, in which.

DETAILED DESCRIPTION OF PREFERRED EMBODIMENTS

Figure 1:
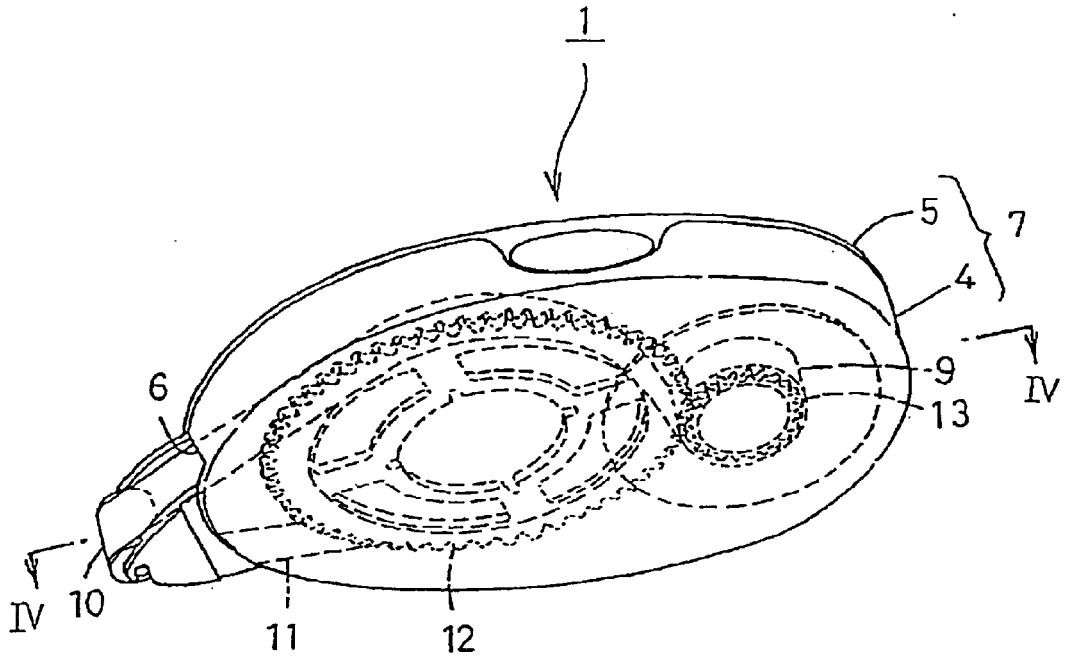
FIG. 1 is a perspective view of a film transfer apparatus according to an embodiment of the present invention taken from a lower side thereof.
Figure 2:
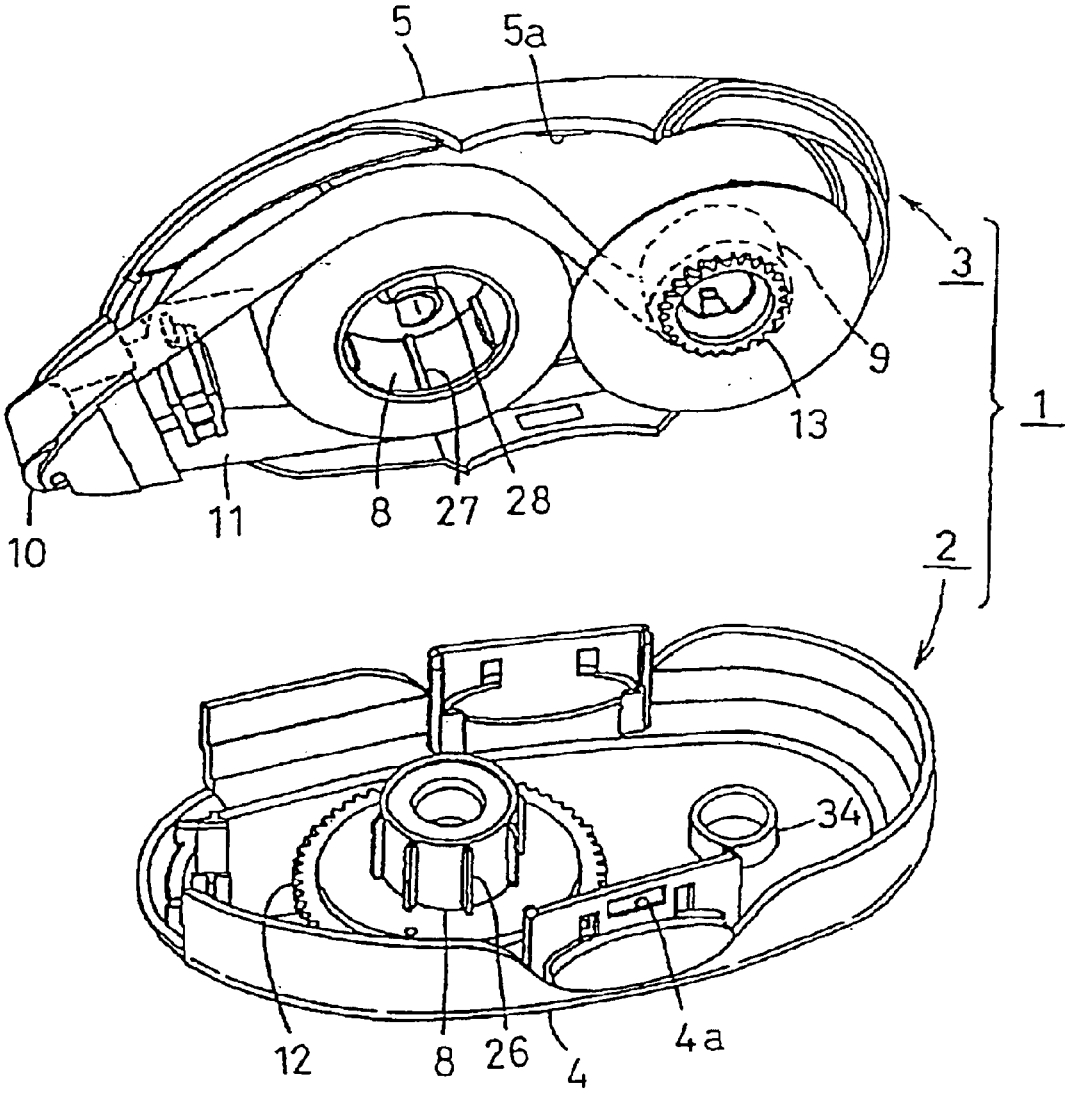
FIG. 2 is a perspective view of the film transfer apparatus of FIG. 1 separated into a case body and a cartridge unit.
Figure 3:
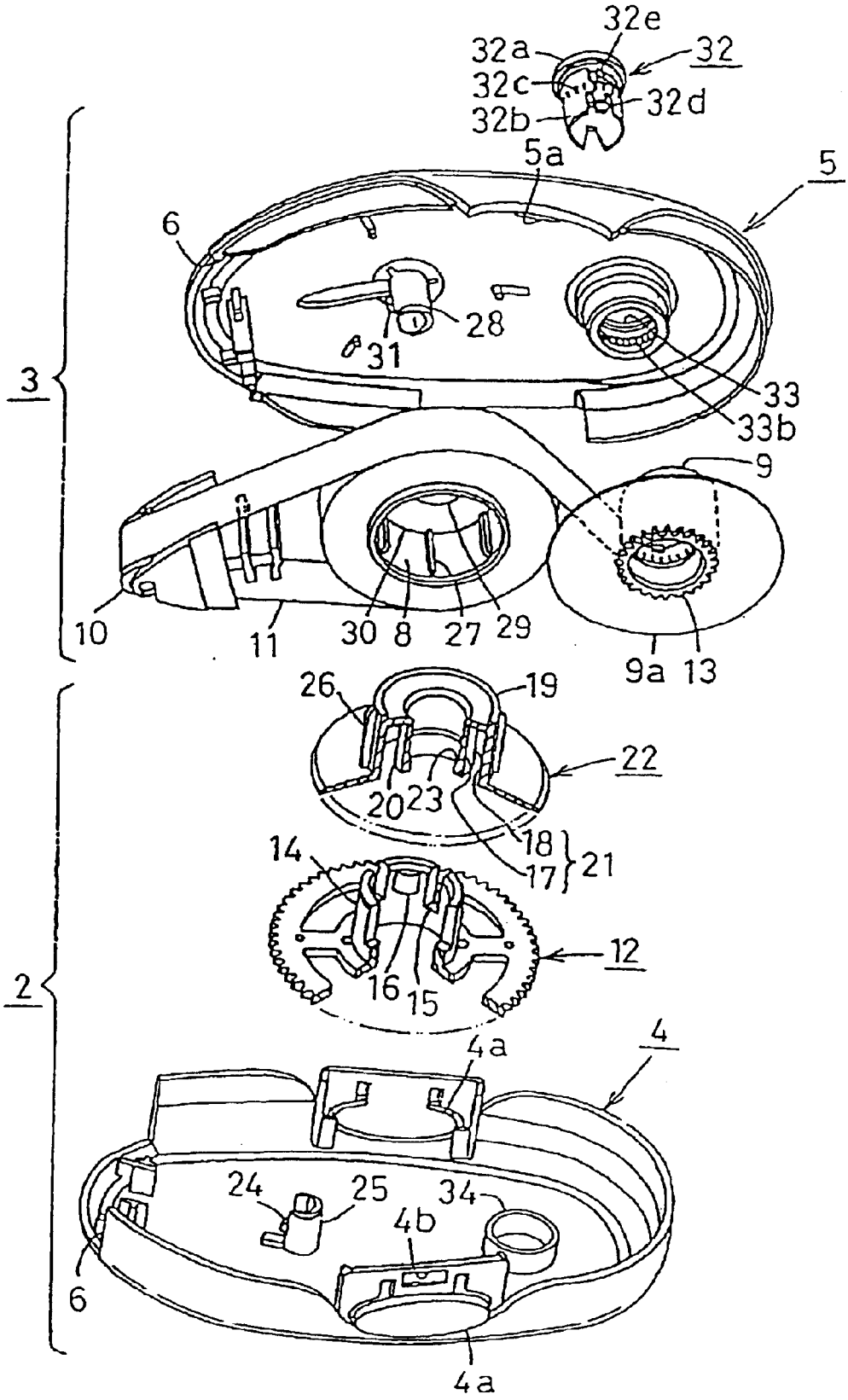
FIG. 3 is an exploded view in perspective of the film transfer apparatus shown in FIG. 1.
Figure 4:
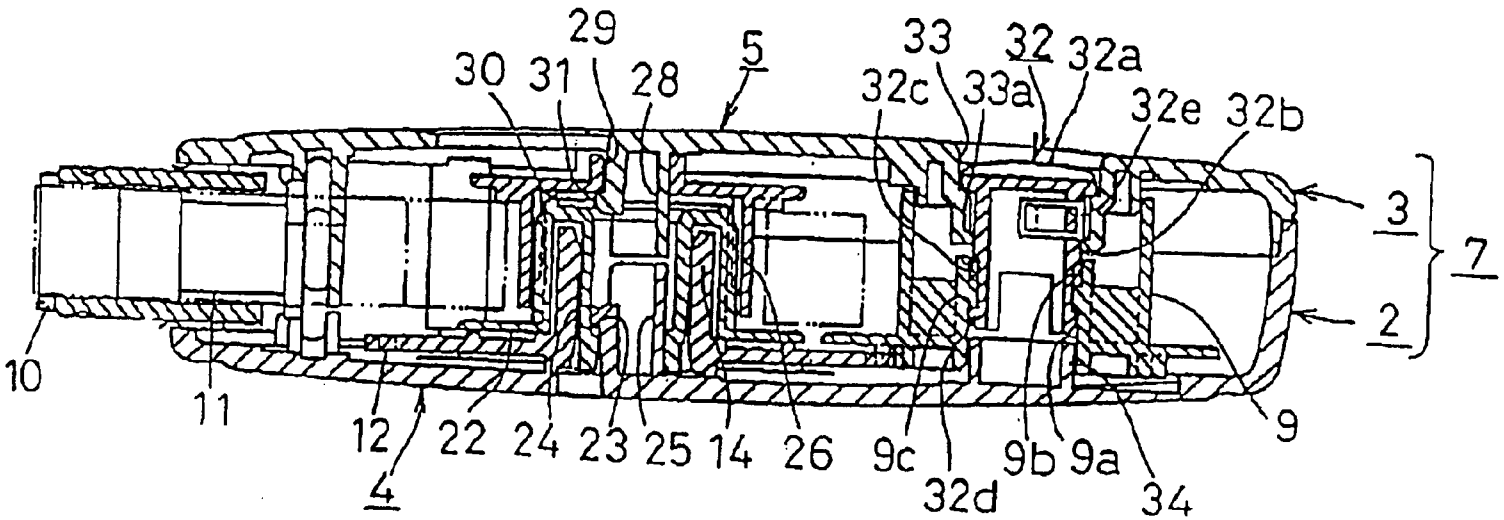
FIG. 4 is a longitudinally sectioned view taken along the line IV—IV in FIG. 1.
Figure 5:
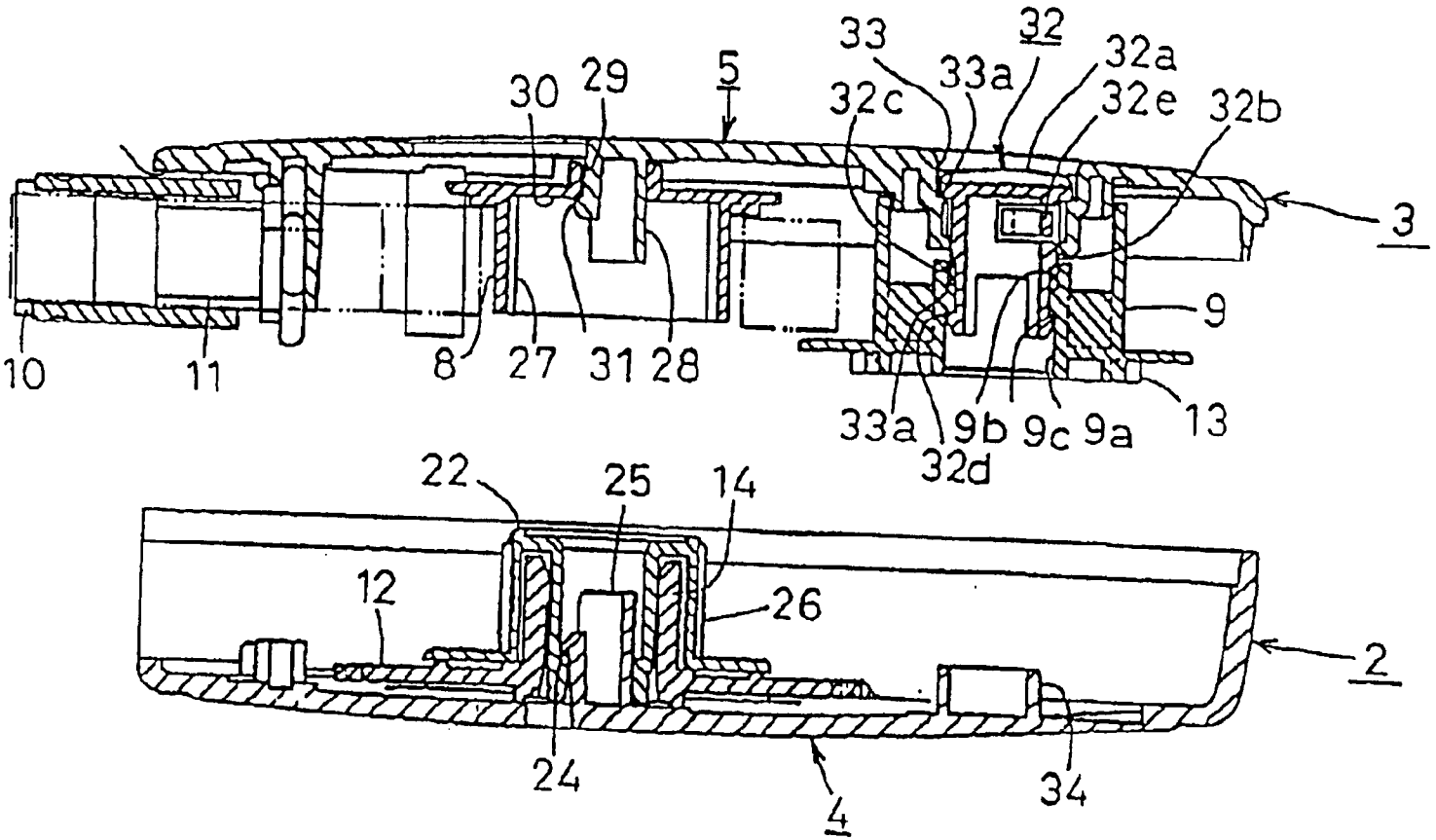
FIG. 5 is a longitudinally sectioned view similar to FIG. 4 but showing the case body and cartridge unit separately.

The invention will be explained in more detail hereinafter with the aid of the drawings in which FIG. 1 is a perspective view of a film transfer apparatus 1 according to the present invention taken from a lower side thereof, FIG. 2 a perspective view of the film transfer apparatus 1 of FIG. 1 separated into a case body 2 and a cartridge unit 3, FIG. 3 an exploded view in perspective of the same film transfer apparatus 1, FIG. 4 a longitudinal sectional view taken along the line IV–VI in FIG. 1, and FIG. 5 a drawing identical with the longitudinal sectional view of FIG. 4 and showing the case body 2 and cartridge unit 3 separately.

The film transfer apparatus 1 according to the present invention is formed by providing a feed reel 8 and a take-up reel 9 in an apparatus body 7 which is made by combining with each other to become one body a pair of flat, slightly wide case members, i.e. a main case member 4 and a covering case member 5 in an opened side opposed state, and which is opened at an opening 6 at a lower end thereof; projecting a transfer head 10 from the opening 6, a transfer tape 11 wound around the feed reel 8 being fed, reversed at a lower tip of the transfer head 10 and taken up around the take-up reel 9.

A feed gear 12 and a take-up gear 13 are provided on the feed reel 8 and take-up reel 9 coaxially therewith. These gears 12, 13 meshing with each other. A boss 14 of the feed gear 12 is provided with a suitable number of slits 15, projections 16 being provided on the portions of an inner circumferential surface of the boss 14 which are among the slits 15.

In an intermediate connecting member 22 having a double cylindrical portion 21 formed by joining at 19 an inner cylinder 17 and an outer cylinder 18 to each other at one of the ends thereof, while an opening 20 being provided at the other ends, the boss 14 of the feed gear 12 is inserted from the opening 20, the boss 14 being then fitted in a pressure contacting state around the inner cylinder 17. Namely, the projections 16 of the boss 14 are elastically engaged with an outer circumferential surface of the inner cylinder 17 by an elastic effect occurring owing to the provision of the slits 15. Owing to this elastic engagement, torque is transmitted between the intermediate connecting member 22 and feed gear 12, and a sliding function is given to the boss with respect to a load of a level not lower than a predetermined level which is to be referred to later.

The intermediate connecting member 22 is provided at a lower section of an inner circumferential surface of the inner cylinder 17 thereof with a locking portion 23, with which a locking portion 24 formed on a support shaft 25 provided on an inner surface of the main case member 4 is engaged, the intermediate connecting member 22 being thereby rotatably supported on the support shaft 25.

Locking ribs 26, 27 are provided on an outer circumferential surface of the outer cylinder 18 and an inner circumferential surface of the feed reel 8 respectively, and the feed reel 8 is fitted around the outer cylinder 18. The two sets of locking ribs 26, 27 are thereby engaged with one another so that torque is transmitted between the feed reel 8 and intermediate connecting member 22.

In this embodiment, an intermediate connecting member 22 having a double cylindrical portion formed of inner and outer cylinders 17, 18 is provided. In another embodiment, an intermediate connecting member formed by providing a flange, the diameter of which is larger than that of the boss 14 of the feed gear 12, on an outer circumference of an upper end portion of, for example, the inner cylinder 17, providing locking ribs on an outer circumferential edge of the flange, and engaging these ribs with the ribs 27 on an inner circumferential surface of the feed reel 8, may also be employed.

In short, the intermediate connecting member 22 may be formed by providing a diametrically enlarged portion, the diameter of which is larger that that of the boss 14 of the feed gear 12, on an outer circumference of the cylindrical portion (corresponding to the inner cylinder 17 in the above-described mode of embodiment) thereof so that the feed reel 8 can be engaged with the cylindrical portion by fitting the former around the latter by utilizing the diametrically enlarged portion.

On the other hand, the covering case member 5 is provided on an inner surface thereof with a support shaft for supporting the feed reel 8 and take-up reel 9 rotatably and directly or indirectly, and engaging these reels with each other. Namely, the covering case member 5 is provided on the inner surface thereof with a support shaft 28 supporting the feed reel 8. The feed reel 8 has a flange 30 having a hole 29, through which the shaft 28 having a locking portion 31 is inserted, the locking portion 31 being thereby engaged with a circumference of the hole 29 of the flange 30. Thus the feed reel 8 is engaged with the support shaft 28 so that the feed reel 8 does not fall therefrom and can be rotated.

The take-up reel 9 is provided at a lower portion thereof with a take-up gear 13 fixed in one body thereto. The take-up reel 9 is rotably supported on a rewinding button 32 fixed to the covering case member 5. The rewinding button 32 including an enlarged head portion 32*a* and a shaft portion 32*b* is fixed rotatably to the covering case member 5 with a lower surface of the enlarged head portion 32*a* of the former engaged with a stepped portion 33*a* of a cylindrical shaft type rewinding hole 33 opened in the covering case member 5.

The shaft portion 32*b* of the rewinding button 32 is provided with locking ribs 32*c* on a lower section thereof, and a locking member 32*d* at a lower end thereof. The locking ribs 32*c* and locking member 32*d* of the rewinding button 32 are engaged with locking ribs 9*b* and locking portion 9*c* provided on an inner circumferential surface of a shaft hole 9*a* of the take-up reel 9. Thus, the take-up reel 9 is fixed to the covering case member 5 via the rewinding button 32 so that the take-up reel 9 does not fall and can be rotated.

A reverse rotation preventing mechanism is formed for preventing the take-up reel 9 from being rotated reversely by elastically engaging a pawl 32*e* provided on a circumferential surface of an upper section of the shaft portion 32*b* of the rewinding button 32 with a toothed portion 33*b* provided in the rewinding hole 33.

The main case member 4 is provided on the inner surface thereof with a cylindrical shaft 34 for rotatably supporting a lower portion of the shaft hole 9*a* of the take-up reel 9.

The operation of the above-mentioned structure will now be described.

When the film transfer apparatus 1 is gripped and moved back as the transfer head 10 is pressed against a surface onto which a film is to be transferred, such as a surface of a sheet, the transfer tape 11 slides on the lower surface of the transfer head 10, and the film is transferred onto the surface of the sheet with the portion of the transfer tape which is wound around the feed reel 8 drawn out, the feed reel 8 being thereby rotated. Consequently, the intermediate connecting member combined with the feed reel 8 in one body via the locking ribs 26, 27 with a predetermined width of clearance left therebetween is driven and rotated. The torque is further transmitted via the projections 16 on the inner surface of the boss 4 of the feed gear 12, which is elastically engaged with the inner cylinder 17 of the intermediate member 22, so that the feed gear 12 is rotated.

The take-up gear 13 meshed with the feed gear 12 is then rotated to cause the take-up reel 9 formed in one body with the take-up gear 13 to be rotated. Thus, the portion of the transfer tape 11 which has been subjected to the transfer of the film thereon onto the surface of a sheet, and which is thereafter reversely turned on the tip of the transfer head 10, is taken up around the take-up reel 9.

As the transfer tape 11 is fed from the feed reel 8 and taken up around the take-up reel 9 via the tip of the transfer head 10, a ratio of radii of the portions of the transfer tape which are wound the feed reel 8 and take-up reel 9 gradually varies. Therefore, when the radius of the portion of the transfer tape which is wound around the take-up reel 9 becomes considerably larger than that of the portion of the transfer tape which is wound around the feed reel 8, a tensile force not smaller than that required to take up the portion of the transfer tape 11 which is fed from the feed reel 8, i.e. a load not lower than the above-mentioned required level occurs on the take-up reel 9 formed in one body with the take-up gear 13, due to a ratio of the teeth of the meshed feed gear 12 and take-up gear 13. The projections 16 on the inner surface of the boss 14 of the feed gear 12 absorb this load of not lower than the required level as the projections slide on the outer circumferential surface of the inner cylinder 17. Thus, a tensile force required to take up the used portion of the transfer tape is always exerted on the take-up reel.

The enlarged head portion 32*a* of the rewinding button 32 is provided with a cruciform or straight line type locking groove. Therefore, when a slack occurs on the transfer tape 11 extended from the feed reel 8 and passed around the take-up reel 9 via the transfer head 10, the slack can be removed by turning the rewinding button 32 by using a screw driver inserted through the rewinding hole 33 of the covering case member 5.

In order to replace the transfer tape 11 with another, an opening button 4*a* of the main case member 4 is pressed so as to disengage a locking hole 4*b* of the main case member 4 and a locking portion 5*a* of the covering case member 5 from each other. As a result, the case body 2 including a main case member 4 on which the intermediate connecting member 22 and feed gear 12 are rotatably supported, and a cartridge unit 3 including the covering case member 5 on which the feed reel 8 and take-up reel 9 around which the transfer tape 11 is wound and the take-up gear 13 are rotatably supported, and to which the transfer head 10 is fixed, can be simply separated from each other.

The feed reel 8, take-up reel 9 and take-up gear 13 are engaged with the covering case member 5 as mentioned above, so that these parts do not fall therefrom. This enables a transfer tape replacement operation to be carried out very efficiently by replacing the cartridge unit 3 with a new cartridge unit and combining in one body the same cartridge unit and the case body 2 with each other again.

Even when the case body 2 and cartridge unit 3 are separated from each other with the former and latter positioned on the upper side and lower side respectively by mistake during a transfer tape replacement operation, the feed gear 12 does not fall since the feed gear is engaged with the main case member 4 via the intermediate connecting member 22.

The operation and effects described above are obtained in the same manner even in a film transfer apparatus of the mode in which the feed gear 8 and take-up reel 9 are transposed, i.e. even in a film transfer apparatus in which the intermediate connecting member 22 is provided on the side of the take-up reel 9.

According to the present invention, the following effects are displayed.

(1) film transfer apparatus capable of replacing the transfer tape with another is provided which prevents the falling of the sliding mechanism-forming parts and feed gear which are usually parts not to be replaced whether the film transfer apparatus is of a cartridge type or of a non cartridge type, and liable to fall from the apparatus body during a transfer tape replacement operation, and which cause the replacement operation to be delayed; and which is capable of easily carrying out the transfer tape replacement operation.

The sliding mechanism, which has heretofore been formed by using many small parts, for example, O-rings, is formed of a small number of parts by using a specific intermediate connecting member in the present invention. This enables a film transfer apparatus to be assembled efficiently, and a transfer tape replacement operation to be carried out efficiently without requiring the disintegration of the sliding mechanism into constituent parts.

(2) The mechanism for transmitting torque among the feed reel, intermediate connecting member and feed gear, and the sliding mechanism interposed between the feed reel and feed gear via the intermediate connecting member can be formed excellently by using a small number of parts.

(3) The transmission mechanism and sliding mechanism referred to in the invention (2) above can be formed easily to a comparatively simple construction so that these mechanisms work with respect to desired loads.

(4) A case member on which the intermediate connecting member and feed gear are rotatably supported is formed as the case body, while the other case member on which the feed reel and take-up reel are rotatably supported is formed as a cartridge unit. Therefore, a transfer tape replacement operation can be carried out efficiently without causing the parts constituting the case body and cartridge unit to fall therefrom. Since one case member serves also as a cartridge base, a transfer tape replaceable type film transfer apparatus can be obtained at an advantageously low cost.

(5) The same effects as mentioned above as under (1) to (4) can be displayed even in the film transfer apparatus of the mode in which the feed gear and take-up gear are transposed.

The above description of the preferred embodiments has been given by way of example. From the disclosure given, those skilled in the art will not only understand the present invention and the attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A film transfer apparatus including a lower end-opened apparatus body formed by combining to one body in a separable manner a pair of case members each having an open side with the opened sides of the case members opposed to each other, a feed reel and a take-up reel provided in the apparatus body, a transfer head projecting outward from a lower opening of the apparatus body, and a transfer tape wound around the feed reel, said transfer tape being adapted to be fed from the feed reel, reversed at a tip of the transfer head, to the take up reel for being taken up therearound, said film transfer apparatus further comprising:

a feed gear and a take-up gear provided coaxially with the feed reel and take-up reel, respectively, and meshing with each other, an intermediate connecting member carrying a cylindrical portion, a boss of the feed gear fitted around the cylindrical portion of the connecting member in a pressure contacting state such that it enables torque to be transmitted between the intermediate connecting member and the feed gear, while permitting a sliding function with respect to each other under a load of a level not lower than a required level, and a support shaft carrying a locking portion and provided on an inner surface of one of the two case members forming said apparatus body, said intermediate connecting member is supported on said support shaft by rotatably engaging the connecting member with the support shaft by utilizing the locking portion of the latter, and a diametrically enlarged portion, the diameter of which is larger than that of the boss, provided on an outer circumference of the cylindrical portion of the intermediate connecting member so that the feed reel can be engaged with the cylindrical portion by fitting the feed reel therearound by utilizing the diametrically enlarged portion.

2. The film transfer apparatus according to claim 1, wherein the intermediate connecting member has a double cylindrical portion formed of an inner cylinder and an outer cylinder joined together at one ends thereof and opened at the other ends, said boss of the feed gear being fitted in a pressure contacting state around the inner cylinder from an opening thereof, locking ribs being provided on an outer circumferential surface of the outer cylinder, the feed reel provided with locking ribs on an inner circumferential surface thereof being fitted around the outer cylinder with the locking ribs of these two parts engaged with one another.

3. The film transfer apparatus according to claim 2, wherein the boss of the feed gear is provided with a suitable number of slits, projections being provided on the portions of an inner circumferential surface of the boss which are among the slits, these projections being elastically engaged with the outer circumferential surface of the inner cylinder of the intermediate connecting member.

4. The film transfer apparatus according to claim 1, wherein the case member which is other than the case member provided with the support shaft which supports the intermediate connecting member is provided on an inner surface thereof with a support shaft which supports the feed reel and take-up reel rotatably and directly or indirectly, and which engages these reels with each other.

5. A film apparatus including a lower end-opened apparatus body formed by combining to one body in a separable manner a pair of case members each having an open side with the opened sides of the case members opposed to each other, a feed reel and a take-up reel provided in the apparatus body, a transfer head projecting outward from a lower opening of the apparatus body, and a transfer tape wound around the feed reel, said transfer tape being adapted to be fed from the feed reel, reversed at a tip of the transfer head, to the take up reel for being taken up therearound, said film transfer apparatus further comprising:

a feed gear and a take-up gear provided coaxially with the feed reel and take-up reel, respectively, and meshing with each other;

an intermediate connecting member carrying a cylindrical portion, a boss of the take-up gear fitted around the cylindrical portion of the connecting member in a pressure contacting state such that it enables torque to be transmitted between the intermediate connecting member and the take-up gear, while permitting a sliding function with respect to each other under a load of a level not lower than a required level, and a support shaft carrying a locking portion and provided on an inner surface of one of the two case members forming said apparatus body, said intermediate connecting member is supported on said support shaft by rotatably engaging the connecting member with the support shaft by utilizing the locking portion of the latter, and a diametrically enlarged Portion, the diameter of which is larger than that of the boss, provided on an outer circumference of the cylindrical portion of the intermediate connecting member so that the take-up reel can be engaged with the cylindrical portion by fitting the take-up reel therearound by utilizing the diametrically enlarged portion.

* * * * *